United States Patent [19]

Miura et al.

[11] Patent Number: 4,533,382

[45] Date of Patent: Aug. 6, 1985

[54] DEVICE AND METHOD FOR MAKING AND COLLECTING FINE METALLIC POWDER

[75] Inventors: Hirohisa Miura; Hiroshi Sato; Toshio Natsume; Hidenori Katagiri, all of Aichi, Japan

[73] Assignee: Toyota Jidosha Kabushiki Kaisha, Toyota, Japan

[21] Appl. No.: 608,112

[22] Filed: May 8, 1984

[30] Foreign Application Priority Data

May 10, 1983 [JP] Japan ..... 58-81536

[51] Int. Cl.[3] ..... B22F 9/00

[52] U.S. Cl. ..... 75/0.5 C; 266/200; 266/207

[58] Field of Search ..... 75/0.5 C, 252, 0.5 B, 75/0.5 BB, 0.5 BC, 251; 264/13; 266/200, 207

[56] References Cited

U.S. PATENT DOCUMENTS 3,352,637 11/1967 Heymer et al. ..... 423/412

4,191,556 3/1980 Rothblatt ..... 75/0.5 B 4,484,943 11/1984 Miura et al. ..... 74/0.5 BA

*Primary Examiner*—Wayland Stallard

*Attorney, Agent, or Firm*—Oblon, Fisher, Spivak, McClelland & Maier

[57] ABSTRACT

Fine powder of a metal is made by vaporizing the metal in a vaporization chamber, mixing the metallic vapor with an inert carrier gas, and then adiabatically expanding the mixture through a nozzle, which preferably is a convergent-divergent nozzle. A jet flow from the nozzle is very rapidly cooled by this adiabatic expansion, which quickly condenses the metal vapor in the jet flow into very fine particles. Optionally the jet flow is directed against a metal powder collecting means, which may be a collection plate, but preferably is a bath of oil which entrains the particles and keeps them from agglomerating together by partially neutralizing their surface activity. Thus fine metal powder with particle diameters of the order of a few hundreds of angstroms can be economically produced.

15 Claims, 3 Drawing Figures

DEVICE AND METHOD FOR MAKING AND COLLECTING FINE METALLIC POWDER

BACKGROUND OF THE INVENTION

The present invention relates to an apparatus and to a method for making fine metal powder, and more particularly relate to such an apparatus and method for making metal powder of which the diameters of the particles are on the order of some few hundreds of angstroms.

The present invention was originally made in Japan, and the first patent application made thereof was Japanese patent application No. 8/536/83, of which priority is being claimed in the present application; and the subject matter of that previous Japanese patent application is hereby incorporated into this specification by reference; a copy is appended to this specification.

In the past, fine metal powder, such as the type of metal powder used for sintering material and as dispersion material for making particle dispersion composite materials, has generally been made by the method of mechanically pulverizing solid metal, by the method of atomizing molten metal, or by the method of colliding a stream of molten metal with an object at low temperature; but the diameters of the particles of metal powder made by such prior art methods as above have typically been of the order to form ten to five hundred microns.

In general, the smaller are the diameters of the particles of a fine metal powder, the better is the metal powder for use as raw material for sintering or for making particle dispersion composite materials, because in the case of sintering the higher the density of the resultant sintered material becomes, and in the case of making a particle dispersion composite material the better the mechanical properties of the composite material become, due to the increase in the total surface area of the particles of the metal powder relative to their total weight, which increases the relative importance of their surface activity. Therefore, it has been realized for a long time that it is very desirable to make fine metal powder with as small a particle diameter as possible, and energetic efforts have been expended with this aim in view.

One method that has been experimented with for making very fine metal particles is called the vacuum vapor deposition method. In this method, a metal is heated in vacuum and is vaporized into gas composed of its atoms, and this gas is then condensed on the surface of a low temperature object. Another method that has been attempted involves vaporizing a metal in a low pressure but not vacuum environment consisting of an inert gas at a pressure of from a tenth to a hundredth of atmospheric pressure or so, so that the vapor of the metal is cooled by the inert gas so as to be brought into the oversaturated state, and condenses into fine powder in either the liquid or the solid phase. This method is called the gas vaporization method, and small amounts of fine metal powder have been produced on an experimental basis in this way.

These methods have been successful in making fine metal powder with average particle diameter less than one micron, but, since all of these methods make use of gradual vapor condensation phenomena, there is a large fluctuation in the particle diameters of the metal powder obtained (i.e. the standard deviation of these diameters is great), and futhermore the rate of production of metal powder is extremely low. In order to improve the productivity of these methods, it is necessary continuously to take out the generated metal vapor from the chamber in which it is generated, and to cool it. Therefore, there have been proposed methods in which the metal vapor is carried on a plasma flow to take it out of the metallic vapor production chamber, and is then cooled by striking it or colliding it against a water cooled copper plate. Also, methods have been proposed in which the metal vapor is absorbed into a sheet of oil which is dripping down, and again is condensed in this way. However, the former method involving the use of a water cooled plate for condensing the metal vapor requires large and expensive facilities, while the latter method of absorption into oil is not good in absorption effiency. Accordingly, in the prior art, it has been difficult to mass produce fine metal powder with very small and uniform particle diameter in an efficient and economical way.

A subsidiary problem that has been realized with the manufacture of fine metal powder is that, when the particle diameters are very small, and when the powder is manufactured in vacuum conditions or in an atmosphere composed of inert gas, the powder may have a tendency towards self ignition when it is removed and is brought into contact with ordinary atmosphere, even at normal temperatures. This is because, as the particle diameter decreases, the surface area of the particles included in a given mass of metal powder increases dramatically, and therefore the activity of the particles increases. Therefore, in the past, it has been recognized to be desirable to perform post processing of fine metal powder before removing it into the atmosphere from vacuum or an inert atmosphere where it has been formed, by forming an oxide film on the surfaces of the particles under controlled conditions. However, according to such conventional methods, this has increased the cost of the process, as well as lowering the quality of the finished product.

SUMMARY OF THE INVENTION

In view of the above detailed problems inherent in the prior art methods of making fine metal powder, the present inventors sought to improve the productivity of the process by seeking to find other ways of cooling the metal vapor as it was generated, and performed many experimental researches in this connection.

Accordingly, it is the primary object of the present invention to provide a method for making fine metal powder, and a device for practicing the method, which can efficiently and effectively manufacture metal powder in reasonable amounts.

It is a further object of the present invention to provide such a device and method for making metal powder, which can manufacture extremely fine metal powder with very small particle diameter.

It is a further object of the present invention to provide such a device and method for making metal powder, which can manufacture fine metal powder of very uniform particle diameter.

It is a yet further object of the present invention to provide such a device and method for making metal powder, which can avoid any self ignition of the metal powder, when it is introduced into the ordinary atmosphere.

According to the most general aspect of the present invention, these and other objects are accomplished by a device for making fine metal powder, comprising: a vaporization chamber for producing metal vapor therein; means for heating said vaporization chamber; means for introducing a flow of inert gas into said vaporization chamber; an exit flow path from said vaporization chamber, comprising a nozzle therealong; a powder collection zone into which the flow out from said nozzle is directed; and means for evacuating gases from said powder collection zone; and by a method for making fine powder of a metal, comprising the steps of: producing vapor of said metal; mixing a flow of inert gas with said vapor of said metal to produce a mixture gas; rapidly cooling said mixture gas by adiabatically expanding it by passing it through a nozzle; and collecting metal powder from a flow out from said nozzle.

As a result of the various experimental researches made by the present inventors, they have discovered that, if as specified above and according to the present invention the generated metal vapor is brought out from the zone in which it is made by directing it through a nozzle, then the rapid adiabatic expansion cooling provided to the metal vapor as it passes through the nozzle is very effective for causing the metal vapor to condense into extremely minute particles. Further, the present inventors discovered that by mixing a quantity of inert gas such as argon or helium, for use as a carrier gas, with this metal vapor, before passing the mixture through the nozzle for adiabatic expansion cooling, the growth in the size of the metal particles resulting from the conglomeration thereof is restricted, and fine metal powder with more even and consistent particle diameters can be made more efficiently. Further, with the addition of this carrier gas, the adjustment of the temperature and pressure conditions before and after the nozzle can be made with very great facility, by controlling the flow rate of this inert gas, and hence the particle diameter of the resulting fine metal powder can be easily and closely controlled. Thus, the metal vapor is prevented by the inert gas from undergoing particle growth through agglomeration, and is continuously and smoothly introduced into the nozzle as carried by the inert gas. Thus it is quite practicable to make metal powder with particle diameter of a few hundred angstroms or so in quantity.

Further, the present inventors have conceived the concept of catching the fine metal particles in the jet flow squirting out from the nozzle in a bath of oil located just under the nozzle. This oil should be a type of oil which has good fluidicity but does not substantially become deteriorated or volatilized in a vacuum, such as vacuum oil or electrical insulation oil. By such a method, the fine metal particles which have just been formed by the adiabatic expansion cooling in the jet from the nozzle are immediately entrained into the oil, and the oil effectively neutralizes their surface activity while at the same time preventing them from agglomerating together. Since thereafter the metal particles exist within the oil in the mutually isolated state, virtually no later conglomeration of the particles ever takes place, and thus it is possible to make even finer metal particles in even greater quantity.

The nozzle may be a convergent nozzle, or a convergent-divergent nozzle (a so called Laval nozzle). However, the latter was much more effective, in order to effect larger adiabatic expansion cooling of the mixture gas through the nozzle. This increase in the cooling rate of the mixture gas promotes generation of finer metal particles, and also helps to prevent agglomeration and sticking together of the metal particles which are being formed, thus helping to promote uniformness of the particle diameters.

The ratio of adiabatic expansion can be best understood from the following. Suppose that the pressure and the temperature of the mixture gas upstream of the nozzle in which adiabatic expansion cooling is performed are $P_1$ (expressed in torr) and $T_1$ (expressed in °K.) and the pressure and temperature of the mixture gas downstream of the nozzle are $P_2$ (again expressed in torr) and $T_2$ (again expressed in °K.), then in the case of a convergent-divergent nozzle the flow speed of the mixture gas passing through the convergent-divergent nozzle is supersonic when the pressure ratio $P_1/P_2$ is greater than or equal to 2.1, and any desired higher acceleration of the mixture gas through the nozzle is available by increasing the pressure ratio, thereby effecting the corresponding larger adiabatic expansion cooling by converting the heat energy of the mixture gas to kinetic energy thereof. When the pressure ratio is relatively small (for instance when $P_1/P_2$ is equal to 2.5), even when it is above said limit ratio so that the downstream speed of the mixture gas is supersonic, the temperature $T_2$ of the gas after passing through the convergent-divergent nozzle is relatively high, and, when the metallic fine powder is to be caught in an oil bath, depending on the kind and the temperature of the oil to be used, there is a danger that part of the oil may burn or evaporate. Thus, it is preferable to keep the pressure ratio $P_1/P_2$ to be equal to or greater than 4.0, preferably equal to or greater than 5.0, and even more preferably equal to 10 or greater, so that the temperature of the mixture gas immediately before colliding with the liquid surface of the oil is lower than the ignition point of the oil. The temperature $T_2$ may be approximately estimated from the following equation, where k is the specific heat ratio of the mixture gas:

$$T_2 = T_1 \times (P_2/P_1)^{(k-1)/k}$$

In the case of a convergent-divergent nozzle, the temperature of the mixture gas can be instantly lowered than the final outlet temperature $T_2$ as estimated by the above equation. On the other hand, in the case of a convergent nozzle, the flow speed of the gas passing through the nozzle is caused to reach the sonic speed by setting the pressure ratio $P_1/P_2$ to be equal to 2.1. It is impossible to raise the flow speed of the mixture gas over the sonic speed in the case of a convergent nozzle, and so the cooling effect and the speed of the metal powder available by a convergent nozzle are correspondingly lower than those available by a convergent-divergent nozzle. However, even in the case of such a convergent nozzle it is possible to achieve a cooling effect which is far greater than that obtained in the conventional gas evaporation method or the like, and so much better results can be obtained in terms of small and uniform particle size of the resulting fine metal powder.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

The present invention will now be described with reference to the preferred embodiments thereof, and with reference to the appended drawings.

EMBODIMENT ONE

Figure 1:
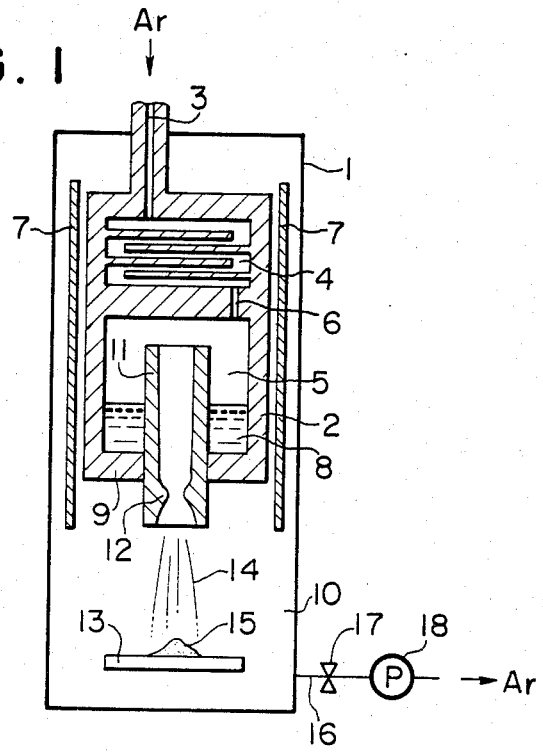
FIG. 1 is a schematic sectional view of an apparatus which is the first preferred embodiment of the device of the present invention, incorporating a convergent-divergent nozzle and a metal powder collection plate, for making and collecting fine powder according to certain embodiments of the method of the present invention.

FIG. 1 shows a schematic cross section of the first preferred embodiment of device of the present invention. In this figure, the reference numeral 1 denotes a furnace shell which is formed as a substantially closed container. In the upper part of this furnace shell 1 there is disposed a melting pot 2, the upper portion of which is formed with a gas preheating chamber 4 to which is communicated a gas introduction port 3 which is communicated with the outside for introduction of an inert gas such as argon gas, and the lower portion of which is formed with a metallic vapor production chamber 5 which is communicated via an aperture 6 with the gas preheating chamber 4. A heater 7 is disposed around the melting pot 2 for keeping it at a predetermined temperature which will be hereinafter referred to as $T_1$, and a mass 8 of metal charged into the lower part of the metallic vapor production chamber 5 is kept in the molten state by the action of this heater 7 and is, further, boiled so as to emit metallic vapor.

Through the bottom wall 9 of the metallic vapor production chamber 5 there is fitted a conduit 11 which leads to a metal powder collection zone 10, and the upper end of this conduit 11 protrudes quite a long way into the chamber 5 so as to open to the upper portion of said chamber 5. At the bottom end of the conduit 11 there is provided a nozzle 12, which in this first preferred embodiment of the present invention is a convergent-divergent nozzle or Laval nozzle, and this nozzle 12 opens downward into the metal powder collection zone 10 so as to direct a jet flow 14 of metal vapor and powder downwards thereinto as will be explained shortly. Below the end of the nozzle 12 in the metal powder collection zone 10 and displaced therefrom by a certain distance there is positioned, in this first preferred embodiment, a metal powder collection plate 13, which is kept cool by a water cooling system which is not shown in the figure. A pile 15 of fine metal powder is shown as being collected on this collection plate 13 by collision of the jet flow 14 with said plate 13. A vacuum pump 18 is provided for exhausting the inert gas such as argon gas introduced through the gas introduction port 3 from the metal powder collection zone 10, via a conduit 16 under the control of a valve 17, so as to maintain the interiors of the metallic vapor production chamber 5 and of the metal powder collection zone 10 at predetermined pressures, which will be hereinafter referred to as $P_1$ and $P_2$ respectively.

By using the device for making fine metal powder shown in FIG. 1 and described above, fine iron powder was made according to the first preferred embodiment of the method of the present invention, as follows. First, a quantity of approximately 40 gm of metallic iron (99.9% Fe, balance impurities) was charged into the lower part of the metalic vapor production chamber 5, and then the temperature of the melting pot 2 and the chambers 4 and 5 defined therein was rapidly raised to a temperature $T_1$ of approximately 2000° C. by operating the heater 7, while a steady flow of argon gas was introduced through the gas introduction port 3. Thus the iron in the metallic vapor production chamber 5 was melted, and was further steadily boiled to produce iron vapor in the chamber 5, this iron vapor mixing with the argon gas flowing into said chamber 5. The mixture gas thus produced (in which the inert argon gas functioned as a carrier gas) then entered the upper end of the conduit 11 and passed down through said conduit 11, to pass through the convergent-divergent nozzle 12 and to be cooled at a very high rate by adiabatic expansion cooling caused by this expansion process to an estimated temperature of about 650° to 850° C. The jet flow 14 expelled from the outlet of the convergent-divergent nozzle 12 squirted into the metal powder collection zone 10 and was directed downwards at the metal powder collection plate 13, which was meanwhile cooled as described above, and which was in this embodiment positioned at a distance of approximately 10 cm from the tip of the nozzle 12. The vacuum pump 18 was operated at such an approximate power, the valve 17 was so adjusted, and the flow rate of the argon gas introduced through the gas introduction port 3 was so controlled, as to keep the pressure $P_1$ within the metallic vapor production chamber 5 at approximately 10 torr, and the pressure $P_2$ within the metal powder collection zone 10 at approximately 1 to 2 torr.

During this process, the iron vapor in the jet flow 14 was condensed to form very fine metallic powder by this adiabatic expansion cooling, and was then steadily collected in a pile on the collection plate 13 as shown by 15, by colliding with said plate 3 along with the inert argon carrier gas. The total time used for processing all the 40 gm of iron charged into the chamber 5 was abut 18 minutes, and the range of the diameters of the particles of fine iron powder produced was from about 110 to about 230 angstroms, while the average particle diameter was about 140 angstroms. Thus, it was found that fine iron powder with particle diameters very much smaller than those attainable in practice by conventional methods was efficiently and practicably produced, according to this first embodiment of the method of the present invention, by using the device shown.

MODIFICATION ONE

Figure 3:
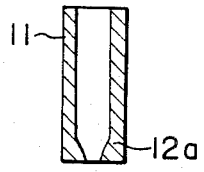
FIG. 3 is a longitudinal sectional view of a convergent nozzle which is used in certain other embodiments of the device of the present invention for practicing certain other method embodiments.

The same experimental production of fine iron powder was repeated, under the same conditions and parameters as described above, but this time using a convergent nozzle 12*a* as illustrated in sectional view in FIG. 3, instead of the convergent-divergent nozzle of the FIG. 1 apparatus. In this case, it was found that the range of the diameters of the particles of fine iron powder produced was from about 120 to about 350 angstroms, while the average particle diameter was about 200 angstroms. Further, the variation of the particle diameters was found to be somewhat greater than in the case of using a convergent-divergent nozzle, described above. Also, the time taken for processing the 40 gm of iron was slightly greater than in the case of the first preferred embodiment, being about 22 minutes, and thus there was a slight deterioration in the productivity of the process. Thus, it was found that the average particle diameter was greater, and the range of variation of particle diameter was also greater, in the case of using a convergent nozzle, than in the case of a convergent-divergent nozzle, and the productivity was worse; but still the quality and evenness of the fine iron powder produced, and the productivity thereof, compared extremely favorably with conventional processes such as those described earlier in this specification with regard to the prior art.

EMBODIMENT TWO

Figure 2:
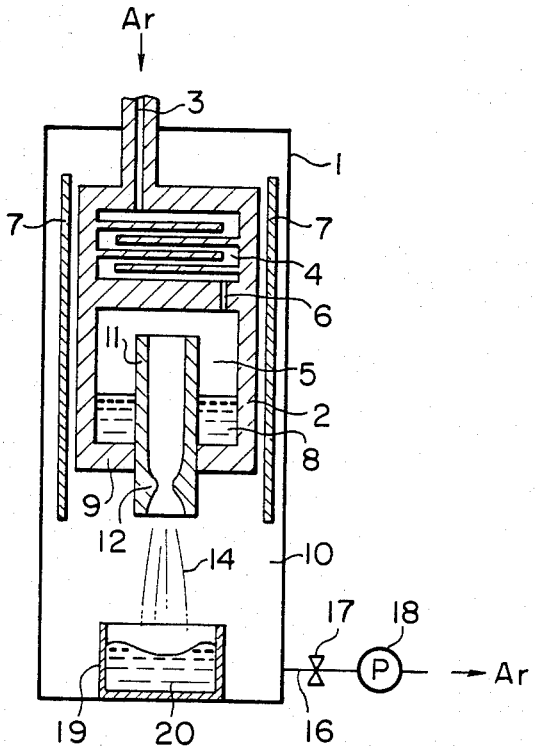
FIG. 2 is a similar schematic sectional view of an apparatus which is the second preferred embodiment of the device of the present invention, again incorporating a convergent-divergent nozzle, but this time incorporating a metal powder collection oil bath, for making and collecting fine powder according to certain other embodiments of the method of the present invention.

In FIG. 2, there is shown a schematic cross section of the second preferred embodiment of the device of the present invention, in a fashion similarly to FIG. 1 with respect to the first apparatus embodiment. In this figure, parts which are similar to parts of the first preferred embodiment shown in FIG. 1 and which have the same functions are denoted by the same reference numerals. This second preferred apparatus embodiment is substantially the same in construction as the first embodiment, except that instead of the collection plate 13 of the first preferred embodiment there is provided, for catching the fine metal particles produced in the jet flow 14, opposing the tip of the convergent-divergent nozzle 12 at a certain distance away therefrom, a bath 19 adapted for receiving a quantity of oil 20.

By using the device for making fine metal powder shown in FIG. 2 and described above, fine iron powder was made according to another preferred embodiment of the method of the present invention, as follows. First, a quantity 20 of approximately 500 cc of vacuum oil, which was of the type "Neovac M-200" (this is a trademark) made by Matsumura Sekiyu K.K., at an initial temperature of 20° C., was put into the oil bath 19, and then approximately 40 gm of metallic iron (again 99.9% Fe, balance impurities) was charged into the lever part of the metallic vapor production chamber 5, and then the temperature of the melting pot 2 and the chambers 4 and 5 defined therein was rapidly raised in the same way as in the case of the first method embodiment described above to a temperature $T_1$ of approximately 2000° C. by operating the heater 7, while a steady flow of argon gas was introduced through the gas introduction port 3. Thus again the iron in the metallic vapor production chamber 5 was melted, and was boiled to produce iron vapor which mixed with the argon gas flowing into said chamber 5. The mixture gas thus produced then entered the upper end of the conduit 11 and passed down through said conduit 11, to pass through the convergent-divergent nozzle 12 and to be cooled at a very high rate by adiabatic expansion cooling caused by this expansion process. The jet flow 14 expelled from the outlet of the convergent-divergent nozzle 12 squirted into the metal powder collection zone 10 and was directed downwards at the oil mass 20 in the oil bath 19, the liquid surface of which was in this embodiment positioned at a distance of approximately 15 cm from the tip of the nozzle 12. The vacuum pump 18 was operated at such an appropriate power, the valve 17 was so adjusted, and the flow rate of the argon gas introduced through the gas introduction port 3 was so controlled, as again to keep the pressure $P_1$ within the metallic vapor production chamber 5 at approximatly 10 torr, and the pressure $P_2$ within the metal powder collection zone 10 at approximately 1 to 2 torr.

During this process, the iron vapor in the jet flow 14 was condensed to form very fine metallic powder by this adiabatic expansion cooling, and was then collected in a dispersed form in the oil mass 20, by colliding with the surface of said liquid oil mass 20 along with the inert argon carrier gas, and by becoming entrained in the oil mass 20 in dispersed form. The total time used for processing all the 40 gm of iron charged into the chamber 5 was about 18 minutes, and the range of the diameters of the particles of fine iron powder produced was from about 80 to about 150 angstroms, while the average particle diameter was about 100 angstroms. Thus, it was found that even more fine iron powder with particles diameters agains even smaller than in the case of the first preferred embodiment described above, and with more evenly distributed particle diameters, and very much finer than iron powder attainable in practice by conventional methods, was efficiently and practicably produced, according to this embodiment of the method of the present invention, by using the device shown. Also it was observed that the tendency of the produced iron powder to agglomerate together was less than in the case of the first embodiment, and no tendency was observed for the resultant powder to oxidize when it was removed from the collection zone 10 and introduced into the atmosphere, thus showing that the intense surface activity of the particles thereof had been effectively neutralized by the action of the collecting oil mass 20.

MODIFICATION TWO

The same experimental production of fine iron powder was repeated, under the same conditions and parameters as described above, but this time using a convergent nozzle 12*a* as illustrated in sectional view in FIG. 3, instead of the convergent-divergent nozzle of the FIG. 2 apparatus. In this case, it was found that the range of the diameters of the particles of fine iron powder produced was from about 90 to about 300 angstroms, while the average particle diameter was about 160 angstroms. Further, the variation of the particle diameters was found to be somewhat greater than in the case of suing a convergent-divergent nozzle, described above. Also, the time taken for processing the 40 gm of iron was slightly greater than in the case described above, being about 22 minutes, and thus there was a slight deterioration in the productivity of the process. Thus, it was found that the average particle diameter was greater, and the range of variation of particle diameter was also greater, in the case of using a convergent nozzle, than in the case of a convergent-divergent nozzle, and the productivity was worse; but still the quality and evenness of the fine iron powder produced, and the productivity thereof, were very good as compared with conventional processes.

EMBODIMENT THREE

The four experiments detailed in Embodiments One and Two and their two modifications above were repeated, but this time using copper as the metal of which fine powder was made. In detail, 40 gm of metallic copper (99.9% Cu, remainder impurities) was charged into the metallic vapor production chamber 5, and then the melting pot 2 and the chambers 4 and 5 defined therein were rapidly heated up to a temperature $T_1$ of approximately 1800° C. by operating the heater 7, while argon gas was introduced through the gas introduction port 3 in the same way as before. Thus this copper was melted and was boiled to produce copper vapor which mixed with the argon gas and flowed out through the nozzle 12 into the powder collection zone 10. Again, the pressure $P_1$ within the metallic vapor production chamber 5 was maintained, by proper operation of the vaccum pump 18, etc., at approximately 10 torr, and the pressure $P_2$ within the metal powder collection zone 10 was maintained at approximately 1 to 2 torr.

In the case of using a convergent-divergent nozzle and a collection plate for collecting the copper powder produced, i.e. in the case corresponding to Embodiment One above in the case of iron, the total time required for processing all the copper was about 10 minutes, and the range of the diameters of the particles of fine copper powder produced was from about 120 to about 220 angstroms, while the average particle diameter was about 150 angstroms. In the case of using a convergent-divergent nozzle and a bath of oil for collecting the copper powder produced, i.e. in the case corresponding to Embodiment Two above in the case of iron, the range of the diameters of the particles of fine copper powder produced was from about 90 to about 170 angstroms, while the average particle diameter was about 110 angstroms. In the case of using a convergent nozzle and a collection plate for collecting the copper powder produced, i.e. in the case corresponding to Modification One above in the case of iron, with the pressure $P_2$ in the case being 3 to 4 torr, the range of the diameters of the particles of the fine copper powder produced was from about 180 to about 350 angstroms, while the average particle diameter was about 230 angstroms. In the case of using a convergent nozzle and a bath of oil for collecting the copper powder produced, i.e. in the case corresponding to Modification Two above in the case of iron, the range of the diameters of the particles of fine copper powder produced was from about 130 to about 270 angstroms, while the average particle diameter was about 160 angstroms. Thus, the variation in the particle diameter and the average particle diameter were both greater when using a convergent nozzle than in the case of using a convergent-divergent nozzle, which confirms the results obtained in the case of iron; and the time required to process the total of 40 gm of copper was about 15 minutes, thus resulting in a slight reduction in productivity.

EMBODIMENT FOUR

The two experiments detailed in Embodiments One and Two were repeated, i.e. those using a convergent-divergent nozzle, but this time using nickel as the metal of which fine powder was made. In detail, 30 gm of metallic nickel (99.8% Ni, remainder impurities) was charge into the metallic vapor production chamber 5, and then the melting pot 2 and the chambers 4 and 5 defined therein were rapidly heated up to a temperature $T_1$ of approximately 2000° C. by operating the heater 7, while argon gas was introduced through the gas introduction port 3 in the same way as before. Thus the nickel was melted and was boiled to produce nickel vapor which mixed with the argon gas and flowed out through the nozzle 12 into the powder collection zone 10. Again, the pressure $P_1$ within the metallic vapor production chamber 5 was maintained, by proper operation of the vacuum pump 18, etc., at approximately 10 torr, and the pressure $P_2$ within the metal powder collection zone 10 was maintained at approximately 3 to 4 torr.

In the case of using a convergent-divergent nozzle and a collection plate for collecting the nickel powder produced, i.e. in the case corresponding to Embodiment One above in the case of iron, the total time required for processing all the nickel was about 12 minutes, and the range of the diameters of the particles of fine nickel powder produced was from about 110 to about 210 angstroms, while the average particle diameter was about 110 angstroms. In the case of using a convergent-divergent nozzle and a bath of oil for collecting the nickel powder produced, i.e. in the case corresponding to Embodiment Two above in the case of iron, the range of the diameters of the particles of fine nickel powder produced was from about 70 to about 130 angstroms, while the average particle diameter was about 100 angstroms. Thus, again, the variation in the particle diameter and the average particle diameter were both greater when using a collection plate than in the case of using a bath of collecting oil, which confirms the results obtained in the case of iron and copper.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A device for making fine metal powder, comprising:

a vaporization chamber for producing metal vapor therein;

means for heating said vaporization chamber;

means for introducing a flow of inert gas into said vaporization chamber;

an exit flow path from said vaporization chamber, comprising a nozzle therealong;

a powder collection zone into which the flow out from said nozzle is directed; and means for evacuating gases from said powder collection zone.

2. A device according to claim 1, wherein said nozzle is a convergent-divergent nozzle.

3. A device according to claim 1, wherein said nozzle is a convergent nozzle.

4. A device according to claim 1, further comprising means for collecting metal powder contained in said flow from said nozzle, said powder collecting means being located in said powder collection zone confronting said nozzle.

5. A device according to claim 4, wherein said powder collecting means comprises a plate on which said flow from said nozzle impinges.

6. A device according to claim 5, wherein said plate is water cooled.

7. A device according to claim 4, wherein said powder collecting means comprises a bath filled with oil.

8. A method for making fine powder of a metal, comprising the steps of:

producing vapor of said metal;

mixing a flow of inert gas with said vapor of said metal to produce mixture gas;

rapidly cooling said mixture gas by adiabatically expanding it by passing it through a nozzle;

and collecting metal powder from a flow out from said nozzle.

9. A method according to claim 8, wherein said nozzle is a convergent-divergent nozzle.

10. A method according to claim 8, wherein said nozzle is a convergent nozzle.

11. A method according to claim 8, wherein said collection of metal powder from the flow out from said nozzle comprises the step of accumulating said metal powder on a collecting plate.

12. A method according to claim 8, wherein said collection of metal powder from the flow out from said nozzle comprises the step of accumulating said metal powder in an oil bath.

13. A method according to claim 8, wherein said metal is iron.

14. A method according to claim 8, wherein said metal is copper.

15. A method according to claim 8, wherein said metal is nickel.

* * * * *